US009237781B2

(12) United States Patent
Shimono

(10) Patent No.: US 9,237,781 B2
(45) Date of Patent: Jan. 19, 2016

(54) SLIDER FASTENER AND METHOD FOR MANUFACTURING SAME

(75) Inventor: Muchiji Shimono, Toyama (JP)

(73) Assignee: YKK Corporation (JP)

( * ) Notice: Subject to any disclaimer, the term of this patent is extended or adjusted under 35 U.S.C. 154(b) by 218 days.

(21) Appl. No.: 14/002,753

(22) PCT Filed: Mar. 4, 2011

(86) PCT No.: PCT/JP2011/055129

§ 371 (c)(1),
(2), (4) Date: Sep. 3, 2013

(87) PCT Pub. No.: WO2012/120602

PCT Pub. Date: Sep. 13, 2012

(65) Prior Publication Data

US 2013/0333166 A1 Dec. 19, 2013

(51) Int. Cl.

| | |
|---|---|
| ***A44B 19/00*** | (2006.01) |
| ***A44B 19/24*** | (2006.01) |
| ***A44B 19/62*** | (2006.01) |
| ***A44B 19/32*** | (2006.01) |
| ***A41H 37/00*** | (2006.01) |
| ***A41H 37/06*** | (2006.01) |
| *A44B 19/34* | (2006.01) |

(52) U.S. Cl.

CPC ..... *A44B 19/24* (2013.01); *A41H 37/003* (2013.01); *A41H 37/06* (2013.01); *A44B 19/32* (2013.01); *A44B 19/62* (2013.01); *A44B 19/34* (2013.01); *Y10T 24/2596* (2015.01); *Y10T 29/49782* (2015.01)

(58) Field of Classification Search

None

See application file for complete search history.

(56) References Cited

U.S. PATENT DOCUMENTS

| | | | | |
|---|---|---|---|---|
| 2,652,705 | A * | 9/1953 | Weinberg | 66/193 |
| 4,392,363 | A | 7/1983 | Matsuda | |
| 2008/0189918 | A1 * | 8/2008 | Kusayama | 24/389 |
| 2008/0289156 | A1 | 11/2008 | Lewis | |

FOREIGN PATENT DOCUMENTS

| | | | |
|---|---|---|---|
| CN | 101054761 | A | 10/2007 |
| DE | 19531950 | A1 | 3/1996 |
| EP | 1908363 | A1 | 4/2008 |
| JP | 2011-19901 | A | 2/2011 |
| TW | 200529776 | A | 9/2005 |
| TW | 253911 | B | 5/2006 |
| WO | 2004/017775 | A1 | 3/2004 |

OTHER PUBLICATIONS

Supplementary European Search Report, European Patent Application No. 11860394.3, mailed Oct. 7, 2014.
International Search Report, PCT Application No. PCT/JP2011/055129, mailed Apr. 26, 2011.
International Preliminary Report on Patentability, PCT Application No. PCT/JP2011/055129, mailed Sep. 10, 2013.

* cited by examiner

*Primary Examiner* — Jack W Lavinder
(74) *Attorney, Agent, or Firm* — Kilpatrick Townsend & Stockton LLP

(57) ABSTRACT

A slide fastener is provided. A pair of fastener element rows respectively provided along opposing one side edge portions of pair of fastener tapes. A slider is configured to engage and disengage the pair of fastener element rows. Tape members are respectively provided in parallel along another side edge portions of the pair of fastener tapes, that are opposite to the one side edge portions. The tape members are respectively sewn to the another side edge portions of the fastener tapes with sewing threads which bridge over the fastener tapes and the tape members.

7 Claims, 14 Drawing Sheets

SLIDER FASTENER AND METHOD FOR MANUFACTURING SAME

This application is a national stage application of PCT/JP2011/055129 which is incorporated herein by reference.

TECHNICAL FIELD

The present invention relates to a slide fastener and a method for manufacturing the same.

BACKGROUND ART

A slide fastener is provided with fastener element rows provided at one side edge portions of fastener tapes. The slide fastener is attached to a garment or the like by sewing such that the slide fastener can be opened and closed only by operating a slider of the slide fastener, thereby making it easy to put on or take off the garment.

In addition to garments, the use of slide fasteners is increasing. For example, covers for electric cords can be included. While covers typically protect electric cords, slide fasteners are required since a certain portion is required to be opened for the purpose of periodic inspection or repair.

In addition, some fields require slide fasteners to have waterproof property and water resistance. In this case, fastener tapes are provided with resin layers on one or both sides thereof. When fastener element rows are engaged with each other, the resin layers are brought into contact with or pressed against each other, thereby realizing waterproof property and water resistance. This type of slide fastener is used, for example, in a wet suit or the like.

SUMMARY OF INVENTION

Problems to be Solved by Invention

When the slider fastener is used for the electric cord cover, it is necessary to cover a plurality of electric cords in some cases. In the related art, the fastener tapes are attached to covering material having a width required for covering the plurality of electric cords or the widths of the fastener tapes are increased to cover the plurality of electric cords.

When the slide fastener is used in the wet suit, the slide fastener may be attached to the wet suit by using sewing threads in some cases. However, since a sewing needle penetrates through fastener tapes and an attached object and water permeates through the portions penetrated by the sewing threads, it becomes necessary to bonding, for example, seam tapes so as to cover the portions penetrated by the sewing threads.

Therefore, recently, the slide fastener may attached by ultrasonic welding, high frequency welding or using an adhesive or the like. In such a case, it is considered to increase the widths of the fastener tapes since it is important to increase the welding area (bonding area).

As described above, since the slide fastener involves different attached objects and different attachment methods depending on the intended use, it is necessary to cope with the differences by using the fastener tapes which are portions to be attached to the attached object.

However, a change in the widths of the fastener tapes for the purpose of coping with the differences makes it necessary to change the setting of an apparatus for manufacturing the slide fastener over the entire processes, thereby resulting in delayed delivery or increased manufacturing cost.

Accordingly, the present invention has been made keeping in mind the above problems, and an object of the present invention is to provide a slide fastener in which the widths of the fastener tapes can be easily changed depending on the intended use of the attached object.

Means for Solving Problems

The object of the present invention is achieved by the following configurations.

(1) A slide fastener including a pair of fastener tapes; a pair of fastener element rows respectively provided along opposing one side edge portions of the pair of fastener tapes; a slider configured to engage and disengage the pair of fastener element rows; and tape members respectively provided in parallel along another side edge portions of the pair of fastener tapes, that are opposite to the one side edge portions, wherein the tape members are respectively sewn to the another side edge portions of the fastener tapes with sewing threads which bridge over the fastener tapes and the tape members.

(2) The slide fastener according to (1), wherein the fastener tapes and the tape members are disposed coplanar in a side-by-side arrangement, and are sewn with the sewing threads that is laterally swung in a width direction to bridge the fastener tapes and the tape members.

(3) The slide fastener according to (1) or (2), wherein a waterproof layer is formed on at least one side of the fastener tapes and the tape members.

(4) The slide fastener according to any one of (1) to (3), wherein a thickness of the another side edge portions of the fastener tapes is greater than a thickness of tape main body portions, and wherein the sewing threads are sewn so as to bridge over the another side edge portions.

(5) The slide fastener according to any one of (1) to (4), wherein the sewing threads are thicker than weft of the fastener tapes and the tape members if the fastener tapes and the tape members are made by weaving, and are thicker than insertion weft of the fastener tapes and the tape members if the fastener tapes and the tape members are made by knitting.

(6) The slide fastener according to any one of (1) to (5), wherein the fastener element rows are woven into the fastener tapes at the time of weaving the fastener tapes.

(7) A method for manufacturing a slide fastener, wherein the slide fastener includes: a pair of fastener tapes; a pair of fastener element rows respectively provided along opposing one side edge portions of the pair of fastener tapes; a slider configured to engage and disengage the pair of fastener element rows; and tape members respectively provided in parallel along another side edge portions of the pair of fastener tapes, that are opposite to the one side edge portions, wherein the tape members are respectively sewn to the another side edge portions of the fastener tapes with sewing threads which bridge over the fastener tapes and the tape members, the method including: attaching the fastener element rows to the one side edge portions of the pair of fastener tapes; disposing the tape members in parallel along the one side edge portions of the fastener tapes; and sewing the tape members to the another side edge portions of the fastener tapes with the sewing threads.

(8) The method according to (7), further including forming a waterproof layer on at least one side of the fastener tapes and the tape members.

Advantageous Effects of Invention

According to the slide fastener of the present invention, the slide fastener is provided with the tape members disposed in parallel along the another side edge portions of the fastener tapes, that are opposite to the one side edge portions and the tape members are sewn to the another side edge portions of the fastener tapes with the sewing threads which bridge over the fastener tapes and the tape members. Consequently, it is easy to change the widths of the fastener tapes depending on the intended use of the attached object. In addition, since the widths of the fastener tapes can be varied without changing the setting of the apparatus for manufacturing the slide fastener, it is possible to rapidly cope with customer needs and suppress an increase in manufacturing cost.

EMBODIMENTS OF INVENTION

Hereinafter, embodiments of a slide fastener according to the present invention will be described in detail with reference to the accompanying drawings. In the following description, as for fastener tapes, a front side refers to a near side with respect to the paper surface of FIG. 1, a back side refers to a far side with respect to the paper surface of FIG. 1, an upper side refers to an upper side with respect to the paper surface of FIG. 1, a lower side refers to a lower side with respect to the paper surface of FIG. 1, a left side refers to a left side with respect to the paper surface of FIG. 1, and a right side refers to a right side with respect to the paper surface of FIG. 1. As for a slider, an upper side refers to a near side with respect to the paper surface of FIG. 1, a lower side refers to a far side with respect to the paper surface of FIG. 1, a front side refers to an upper side with respect to the paper surface of FIG. 1, a rear side refers to a lower side with respect to the paper surface of FIG. 1, a left side refers to a left side with respect to the paper surface of FIG. 1, and a right side refers to a right side with respect to the paper surface of FIG. 1. In addition, the right and left direction of the fastener tapes and the slider is also referred to as a width direction. The upward and downward direction of the fastener tapes is also referred to as a longitudinal direction. In addition, the front and back direction of the fastener tapes is also referred to as a thickness direction (a height direction).

Figure 1:
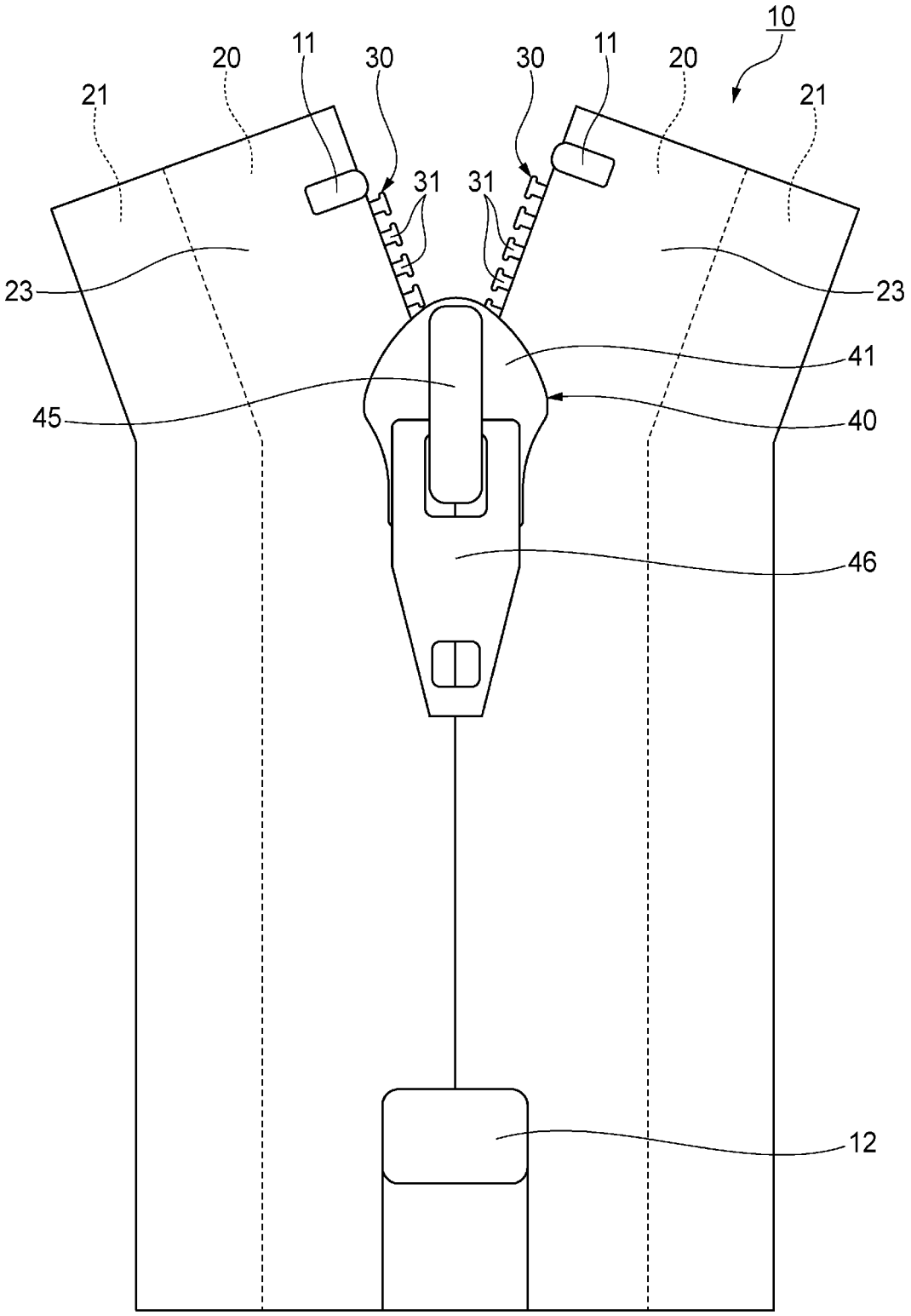
FIG. 1 is a front view illustrating an embodiment of a slide fastener according to the present invention.
Figure 2:
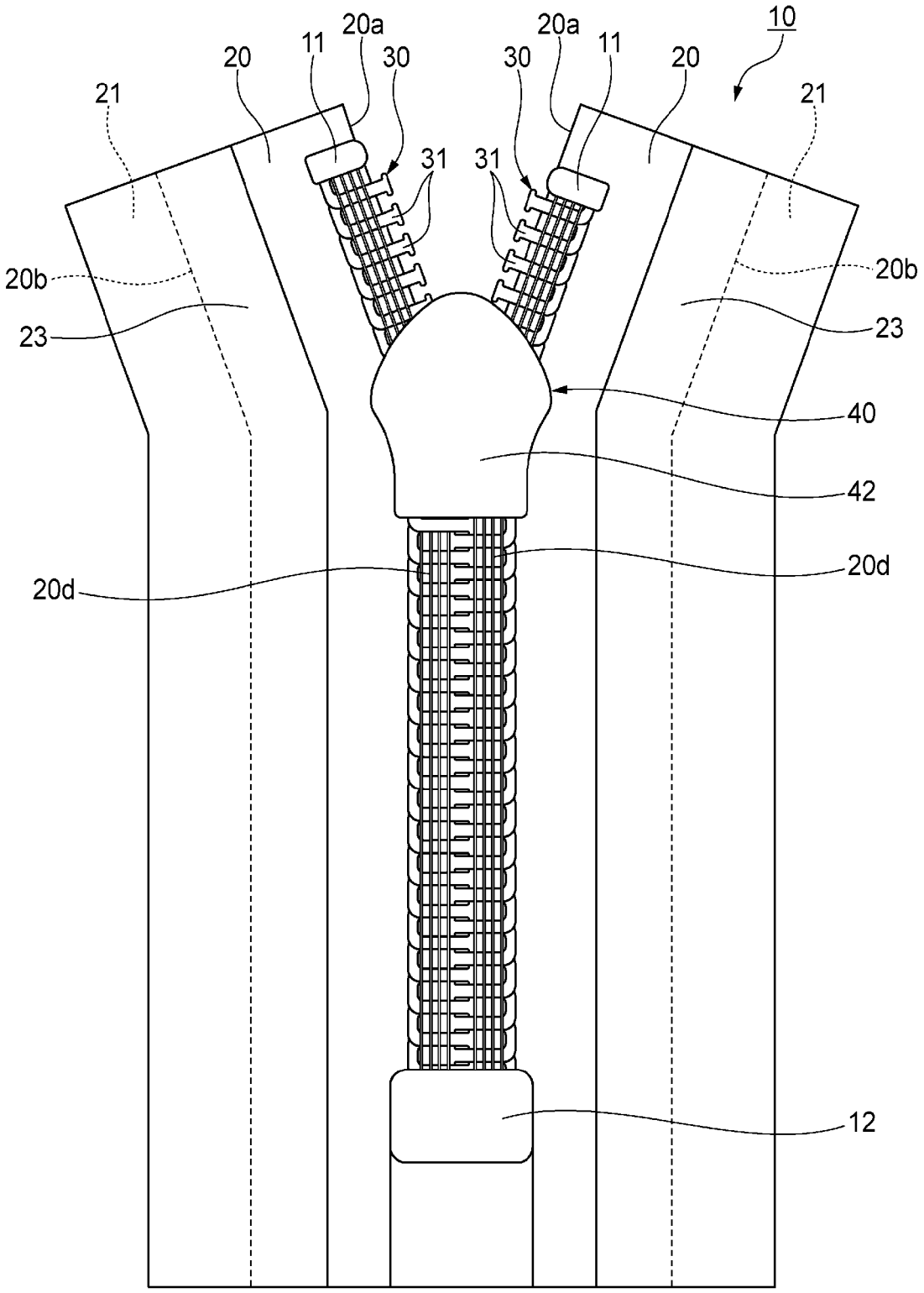
FIG. 2 is a rear view of the slide fastener shown in FIG. 1.
Figure 3:
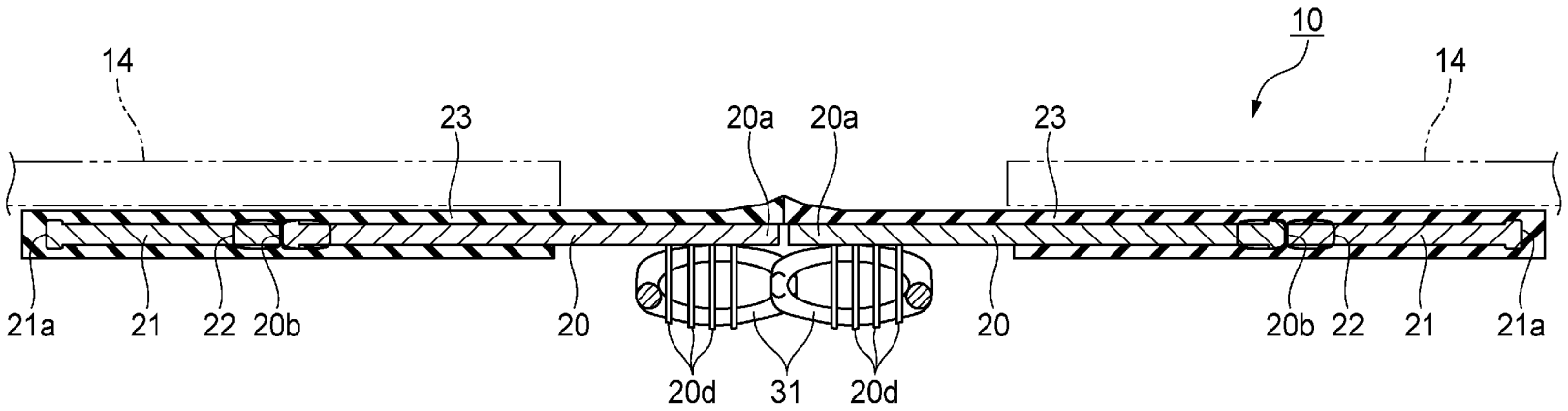
FIG. 3 is a cross-sectional view of the slide fastener shown in FIG. 1.

As shown in FIG. 1 to FIG. 3, the slide fastener 10 according to this embodiment includes a pair of right and left fastener tapes 20, a pair of right and left fastener element rows 30 which are respectively provided along opposing one side edge portions 20*a* of the pair of right and left fastener tapes 20, a slider 40 which is configured to engage and disengage the pair of right and left fastener element rows 30, top end stops 11 which are respectively provided adjacent to upper end portions of the right and left fastener element rows 30, and a bottom end stop 12 which is provided adjacent to the lower end portions of the right and left fastener element rows 30. When the slider 40 is moved from a side of the bottom end stop 12 to a side of the top end stops 11 (moved upward), the pair of right and left fastener element rows 30 are engaged with each other. When the slider 40 is moved in the opposite direction (moved downward), the pair of right and left fastener element rows 30 are disengaged from each other. In addition, the bottom end stop 12 may be a separable end stop which includes an insert pin, a box pin and a box body. The fastener tapes 20 may be made by knitting. In addition, reference numeral 14 in FIG. 3 indicates an attached object such as a wet suit, to which the slide fastener 10 is attached.

Figure 4:
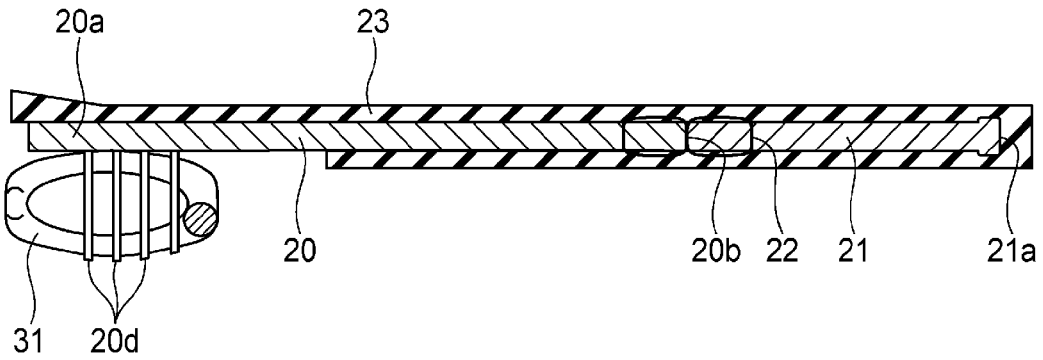
FIG. 4 is an enlarged cross-sectional view of the right fastener tape shown in FIG. 3.

As shown in FIG. 3 and FIG. 4, the slide fastener 10 further includes a pair of right and left tape members 21 disposed in parallel along another side edge portions 20*b* of the pair of right and left fastener tapes 20, which are opposite to the one side edge portions 20*a* so as not to overlap with the fastener tapes 20. The tape members 21 are sewn to the another side edge portions 20*b* of the fastener tapes 20 with sewing threads 22 which bridge over the fastener tapes 20 and the tape members 21. That is, the thickness of the fastener tapes 20 and the tape members 21 in a state where they are sewn with the sewing threads 22 is substantially the same as and is coplanar with the thickness of the fastener tapes 20 and the thickness of the tape members 21, and does not become a thickness in which two tapes are overlapped. In addition, bridging of the sewing threads 22 over the fastener tapes 20 and the tape members 21 also indicates that the sewing threads 22 sews the fastener tapes 20 and tape members 21 alternately in a zigzag shape while being laterally swung in the right and left direction. In addition, in the longitudinal direction, the length of the fastener tapes 20 and the length of the tape members 21 are equal to each other. According to this embodiment, for example, the width of the fastener tape 20 is 25 mm, and the width of the tape member 21 is 15 mm. In addition, while the tape members 21 according to this embodiment are made by weaving, the tape members 21 may also be made by knitting. It is preferred that the size of the tape member 21 be smaller than the size of the fastener tape 20 in the width direction since the width of the tape member 21 can be easily changed at the time of weaving the tape member 21.

Figure 5:
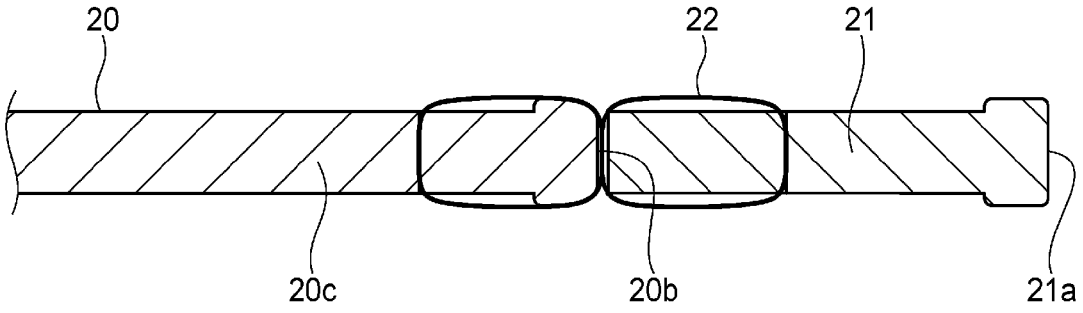
FIG. 5 is an enlarged cross-sectional view of the sewn portions between the fastener tape and the tape member.
Figure 6:
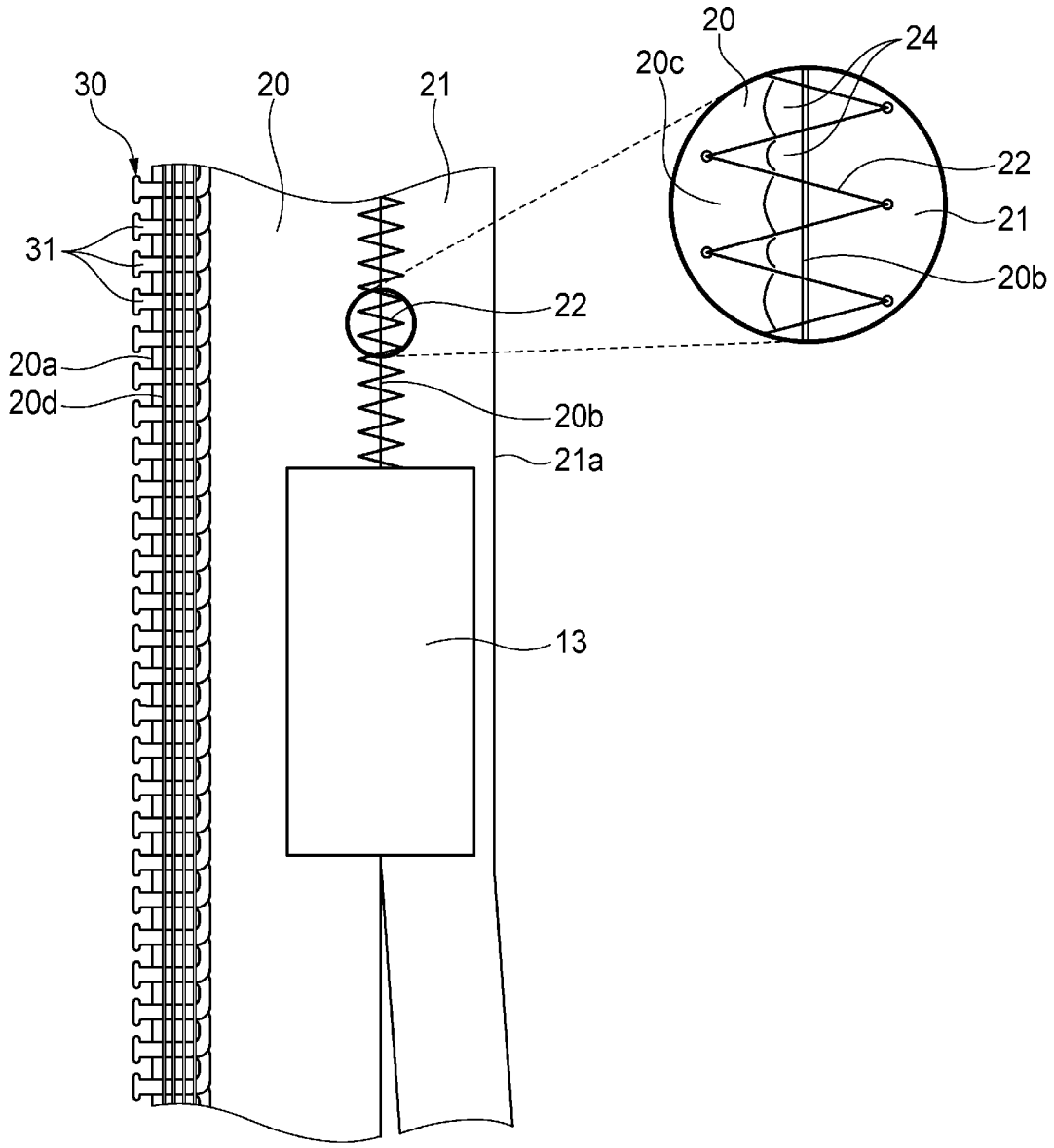
FIG. 6 is a view illustrating a method of sewing the fastener tape and the tape member with each other.
Figure 7:
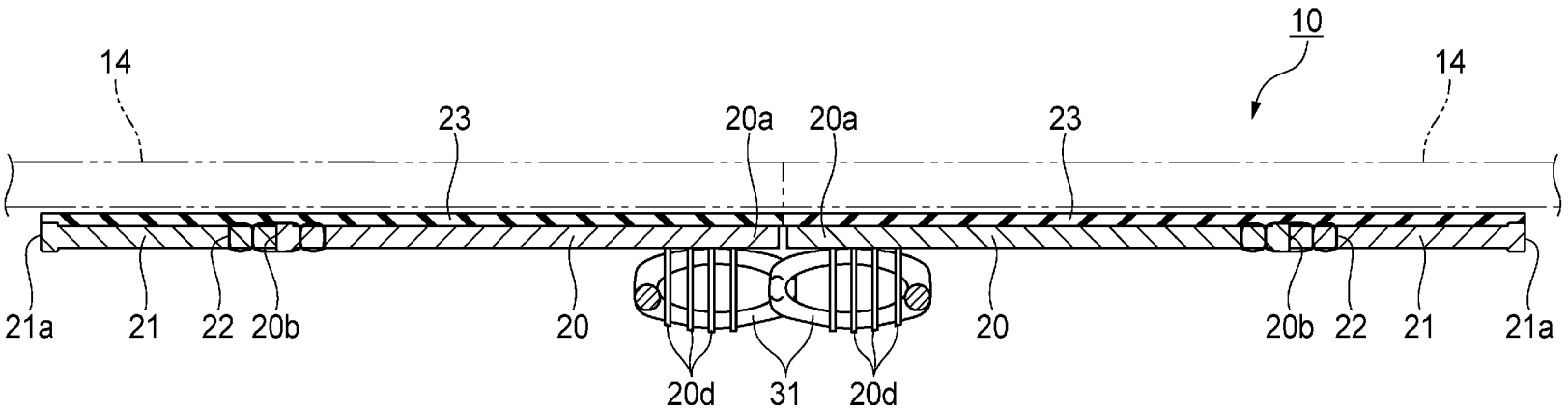
FIG. 7 is a cross-sectional view illustrating a first modified embodiment of the slide fastener according to the present invention.
Figure 8:
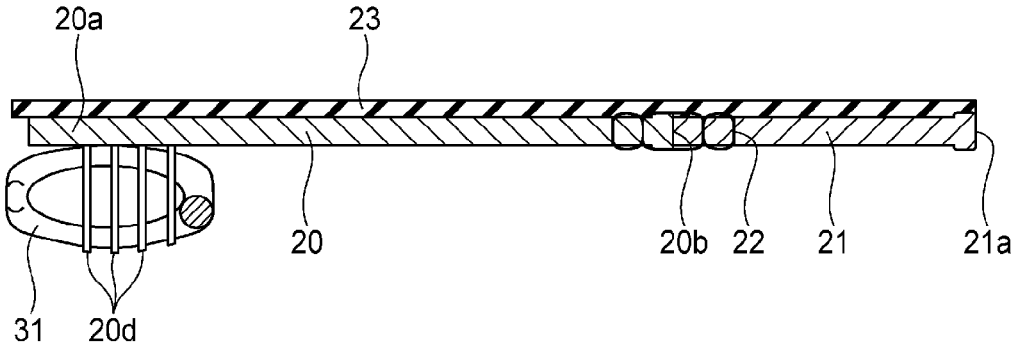
FIG. 8 is an enlarged cross-sectional view of the right fastener tape shown in FIG. 7.

In addition, each of the fastener tapes 20 has a tape main body portion 20*c* between the one side edge portion 20*a* and the another side edge portion 20*b*. As shown in FIG. 5, the another side edge portion 20*b* of the fastener tape 20 is formed thicker than the tape main body portion 20*c*, and the sewing thread 22 is disposed so as to bridge over the another side edge portion 20*b*. That is, while the sewing thread 22 is a sewing thread that runs in the zigzag shape, the folding portions of the sewing thread 22 at the side of the fastener tape 20 are present on the tape main body portion 20*c*. In addition, the opposite folding portions of the sewing thread 22 are present on the tape member 21. Accordingly, as shown in FIG. 6, the another side edge portion 20*b* is fastened by the sewing thread 22 so as to have a convex shape, whereby the sewing threads 22 can be prevented from being misaligned in position.

While the sewing threads 22 according to this embodiment are sewn by laterally swinging the sewing needle of a sewing machine in accordance with three-point zigzag sewing, the sewing threads 22 may be sewn in accordance with two-point zigzag sewing or four-point zigzag sewing. Here, the zigzag sewing is also referred to as staggered sewing. The zigzag sewing means that sewing in which the sewing thread 22 is swung in the width direction which is perpendicular to the longitudinal direction of the fastener tapes 20 and the tape members 21 and the swinging is performed alternately to the right and to the left. In the three-point zigzag sewing as an example of the zigzag sewing, the sewing machine 13 has a needle thread and bobbin a thread at the front side and the back side of the fastener tape 20, the needle thread and the bobbin thread are entangled at two points of the right and left ends which are the folding portions of the zigzag shape, and the needle yarn and the bobbin yarn is entangled at one point between the two points. In the two-point zigzag sewing, the sewing is performed only with the two points of the right and left folding, which are included in the three-point zigzag sewing and the needle thread and the bobbin thread are not entangled between the two points.

The sewing threads 22 are set to be thicker than the weft of the fastener tapes 20 and the tape members 21 which are respectively made by weaving. The thickness of thread is designated by decitex. It can be said that the greater the decitex is, the thicker the thread is. If the fastener tapes 20 and the tape members 21 are made by knitting due to warp knitted fabric, the sewing threads 22 are set to be thicker than insertion weft that connect wale formed so as to extend in the longitudinal direction of the tape. In addition, the fastener tapes 20 and the tape members 21 may be sewn with the sewing threads 22 after being respectively dyed or may be dyed after being sewn with the sewing threads 22.

As shown in FIG. 3 and FIG. 4, a waterproof layer 23 is formed on both of the front and back surfaces of the fastener tapes 20 and the tape members 21 and on the side surfaces of outer edge portions 21*a* of the tape members 21 (on the opposite side of the fastener tapes 20). The waterproof layers 23 formed on both of the front and back surfaces are continued by the waterproof layer 23 formed on the side surface of the outer edge portions 21*a*. The waterproof layer 23 is the layer that is made of thermoplastic elastomer (e.g. polyester elastomer or polyurethane elastomer), natural rubber or synthetic rubber and does not allow fluid, for example liquid, such as water or oil, or air, to pass therethrough. The portions of the waterproof layer 23 at the front side of the fastener tapes 20 and the tape members 21 cover the entire width of the fastener tapes 20 and the tape members 21. In addition, in a state where the fastener element rows 30 are engaged with each other, the waterproof layers 23 formed on the right and left fastener tapes 20 and the right and left tape members 21 abut to each other at the side of the one side edge portions 20*a*, thereby preventing water or the like from passing therethrough. In addition, the portions of the waterproof layers 23 at the back side of the fastener tapes 20 and the tape members 21 extend from the outer edge portions 21*a* of the tape members 21 toward the one side edge portions 20*a* of the fastener tapes 20, and extend beyond the connecting portions by the sewing threads 22 which connect the fastener tapes 20 to the tape members 21. It is preferred that the waterproof layer 23 extend to the side of the one side edge portions 20*a* of the fastener tapes 20 beyond the center of the fastener tapes 20 and tape members 21 in the width direction. Although the attached object 14 is present only at the front side in FIG. 3, the attached object 14 may be present at the back side. Here, the waterproof layer 23 is laminated on both of the front and back surfaces of the fastener tapes 20 and the tape members 21. A laminating method may be implemented as lamination or extrusion.

As shown in FIG. 2 and FIG. 4, the fastener element rows 30 are coil-shaped fastener element rows, each of which is formed by winding a monofilament made of synthetic resin in a constant direction. Each of the fastener element rows 30 has a plurality of fastener elements 31 having engagement portions. The fastener element rows 30 are woven into the one side edge portions 20*a* of the fastener tapes 20 at the time of weaving the fastener tapes 20. Specifically, the fastener element rows 30 are formed at the back sides of the one side edge portions 20*a* by being woven with warp threads 20*d* of the one side edge portion 20*a*. This type of slide fastener may be referred to as a woven slide fastener. The fastener element row 30 may be a fastener element row that is made by converting a monofilament made of synthetic resin into a zigzag shape. In addition, coil-shaped fastener elements may be sewn into the fastener tape using a sewing machine. A synthetic resin material for the monofilament may be polyester, nylon or the like. The fastener elements 31 may be made by extruding synthetic resin, and the fastener elements 31 may be made of metal. The present invention can be suitably used in the woven slide fastener. This is because it becomes necessary to significantly modify the manufacturing apparatus to change the width of the fastener tape 20 since the fastener element row 30 is woven at the same time as the fastener tape 20 is being woven. This consequently leads to delayed delivery or cost up.

As shown in FIG. 1 and FIG. 2, the slider 40 includes an upper blade 41 and a lower blade 42 which are spaced apart from each other in the upward and downward direction so as to be disposed in parallel to each other, a guide post (not shown) which connects the front end portion of the upper blade 41 with the front end portion of the lower blade 42, a pull-tab attachment portion 45 which is provided on the upper surface of the upper blade 41, and a pull-tab 46 which is attached to the pull-tab attachment portion 45.

Next, a method for manufacturing a slide fastener according to the present invention will be described.

The method of manufacturing the slide fastener 10 according to this embodiment includes a process of attaching (weaving) the fastener element rows 30 to the one side edge portions 20*a* of the pair of right and left fastener tapes 20, a process of disposing the tape members 21 in parallel along the another side edge portions 20*b* of the pair of right and left fastener tapes 20 in a side-by-side arrangement, a process of sewing the tape members 21 to the another side edge portions 20*b* of the pair of right and left fastener tapes 20 with sewing threads 22, and a process of forming the waterproof layer 23 on both of front and back surfaces of the fastener tapes 20 and the tape members 21. After the tape members 21 are sewn to the another side edge portions 20*b* of the fastener tapes 20, the waterproof layer 23 is formed on both of the front and back surfaces of the fastener tapes 20 and the tape members 21. A process of dying the fastener tapes 20 and the taper members 21 may be performed before or after the sewing process.

As described above, according to this embodiment, the slide fastener 10 includes the pair of right and left tape members 21 disposed in parallel along the another side edge portions 20*b* of the pair of right and left fastener tapes 20 and the tape members 21 are sewn to the another side edge portions 20*b* of the fastener tapes 20 with the sewing threads 22 which bridge over the fastener tapes 20 and the tape members 21. Consequently, it is easy to change the widths of the fastener tapes 20 depending on the intended use of the attached object. In addition, since the widths of the fastener tapes 20 can be varied without changing the setting of the apparatus for manufacturing the slide fastener 10, it is possible to rapidly cope with customer needs and suppress an increase in manufacturing cost.

When the waterproof layer is formed on at least one side of one sheet of a wide fastener tape as in the related art, the bonding force between the fastener tape and the waterproof layer likely becomes weak near the center portion in the width direction. Thus, after attachment to the attached object by ultrasonic welding or high frequency welding or using an adhesive, the waterproof layer 23 may be peeled off. However, if the tape member 21 is sewn to the another side edge portion 20*b* of the fastener tape 20 as in this embodiment, the waterproof layer 23 is formed to cover the sewing portions of the sewing threads 22. Thus, since the sewing thread 22 is tightly attached to the waterproof layer 23, the bonding force can become strong. In addition, since the another side edge portions 20*b* which are formed thicker than the tape main body portions 20*c* form a plurality of bluged portions 24 along the longitudinal direction of the fastener tapes 20 due to the sewing threads 22, it is possible to increase the contact area to the waterproof layer 23, thereby increasing the bonding force near the center portion in the width direction (see the enlarged view of FIG. 6).

Figure 9:
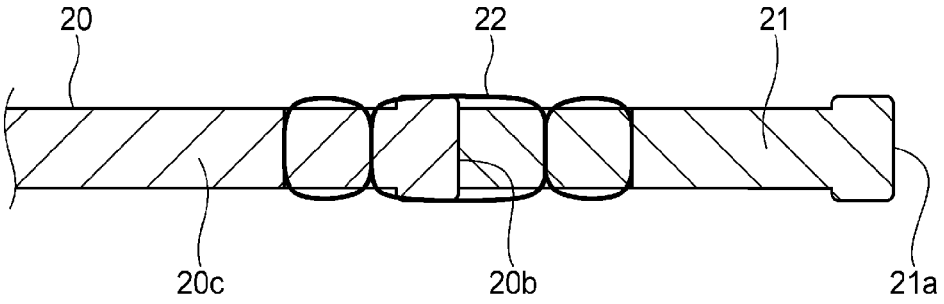
FIG. 9 is an enlarged cross-sectional view of the sewn portions between the fastener tape and the tape member according to the first modified embodiment.
Figure 10:
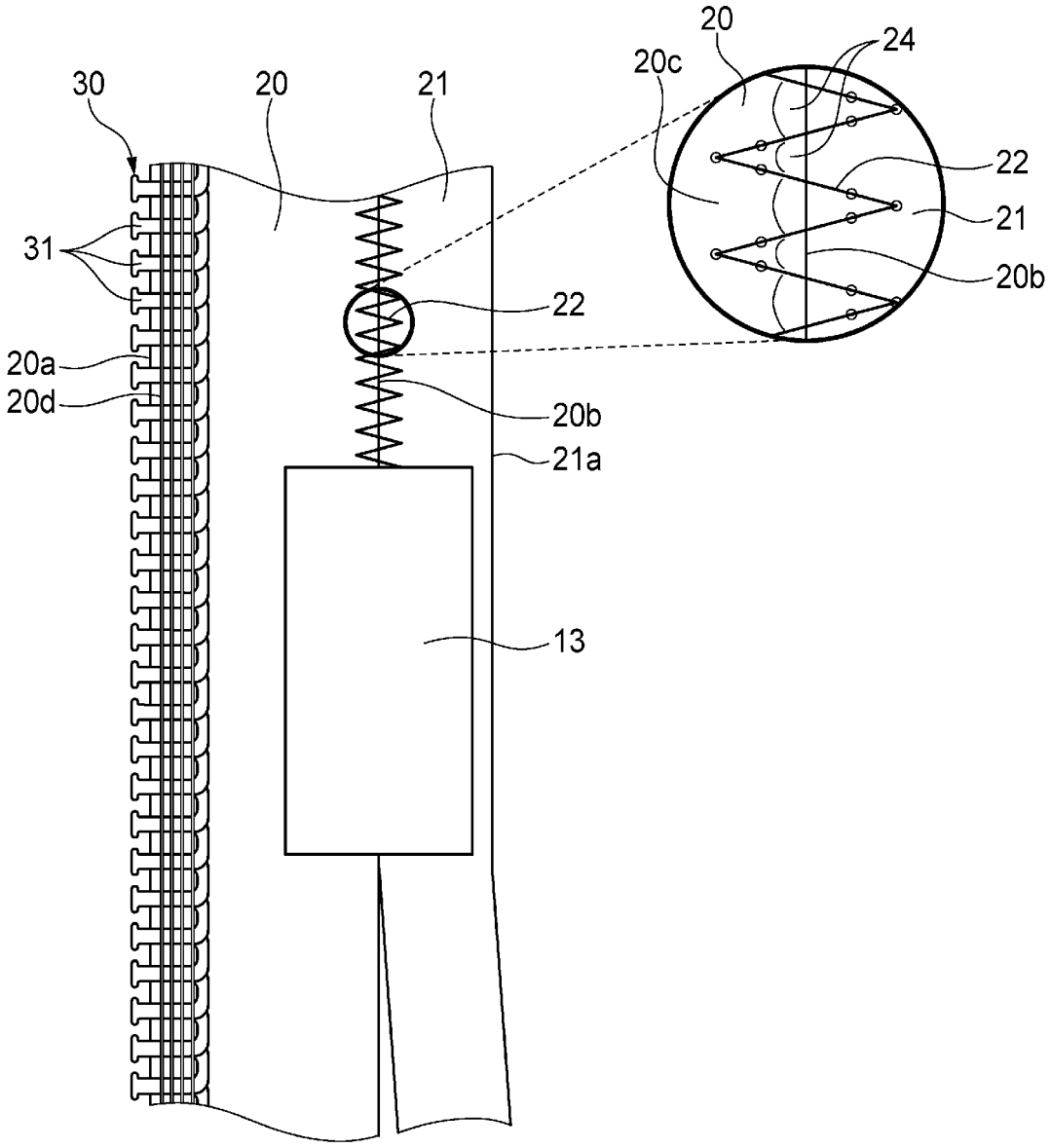
FIG. 10 is a view illustrating a method of sewing the fastener tape and the tape member with each other according to the first modified embodiment.

In addition, according to a first modified embodiment of this embodiment, as shown in FIG. 7 to FIG. 10, the sewing threads 22 sew the tape members 21 to the fastener tapes 20 in accordance with four-point zigzag sewing. The waterproof layer 23 may be formed only on the front side of the fastener tapes 20 and the tape members 21. Here, the four-point zigzag sewing has two points of the right and left folding and additional two points where needle thread and bobbin thread are entangled between the two points, as shown in FIG. 9 and FIG. 10. In particular, the three-point zigzag sewing or four-point zigzag sewing is more preferable than the two-point zigzag sewing since the fastener tapes 20 and the tape members 21 are firmly sewn.

Figure 11:
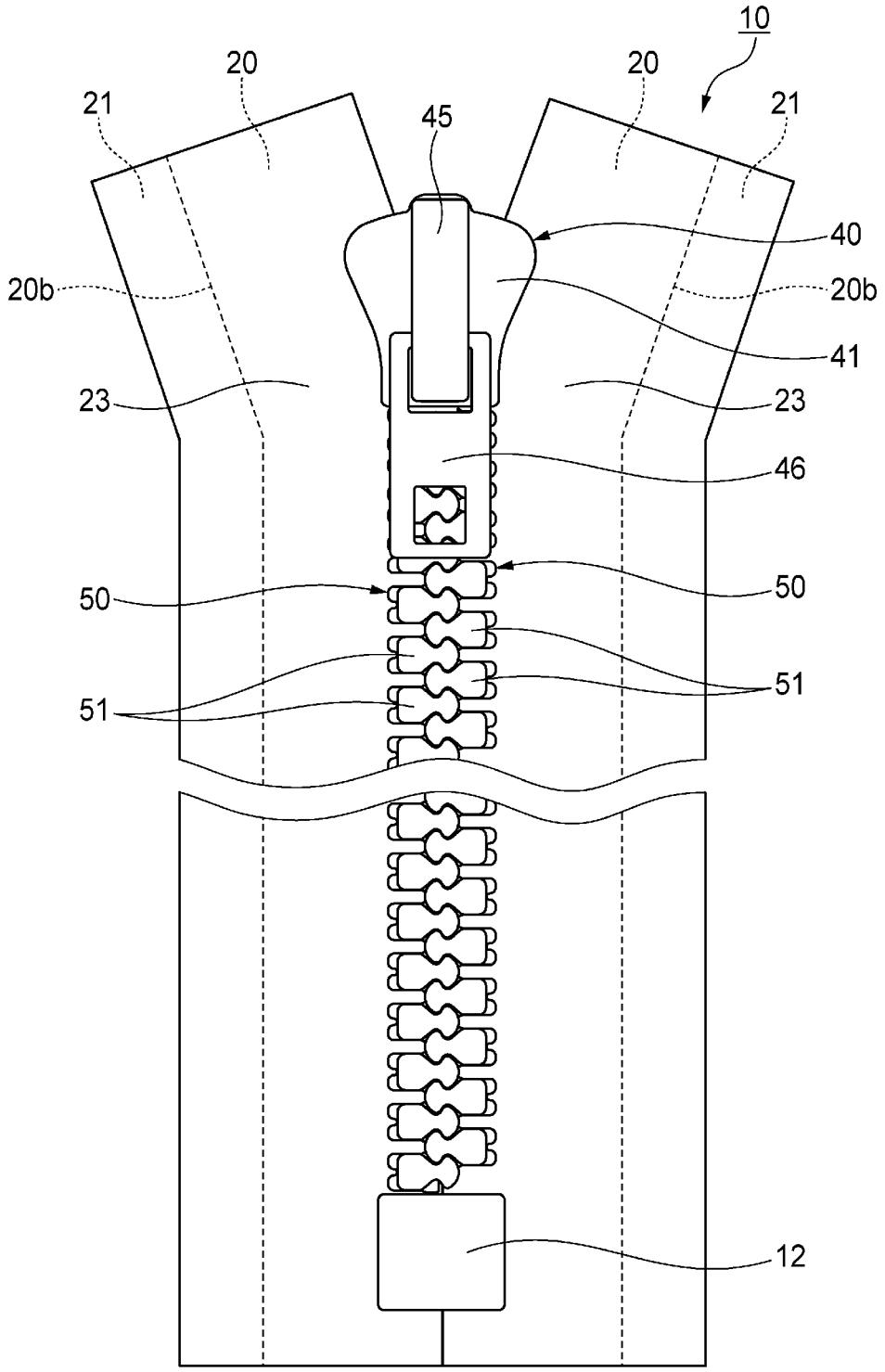
FIG. 11 is a front view illustrating a second modified embodiment of the slide fastener according to the present invention.
Figure 12:
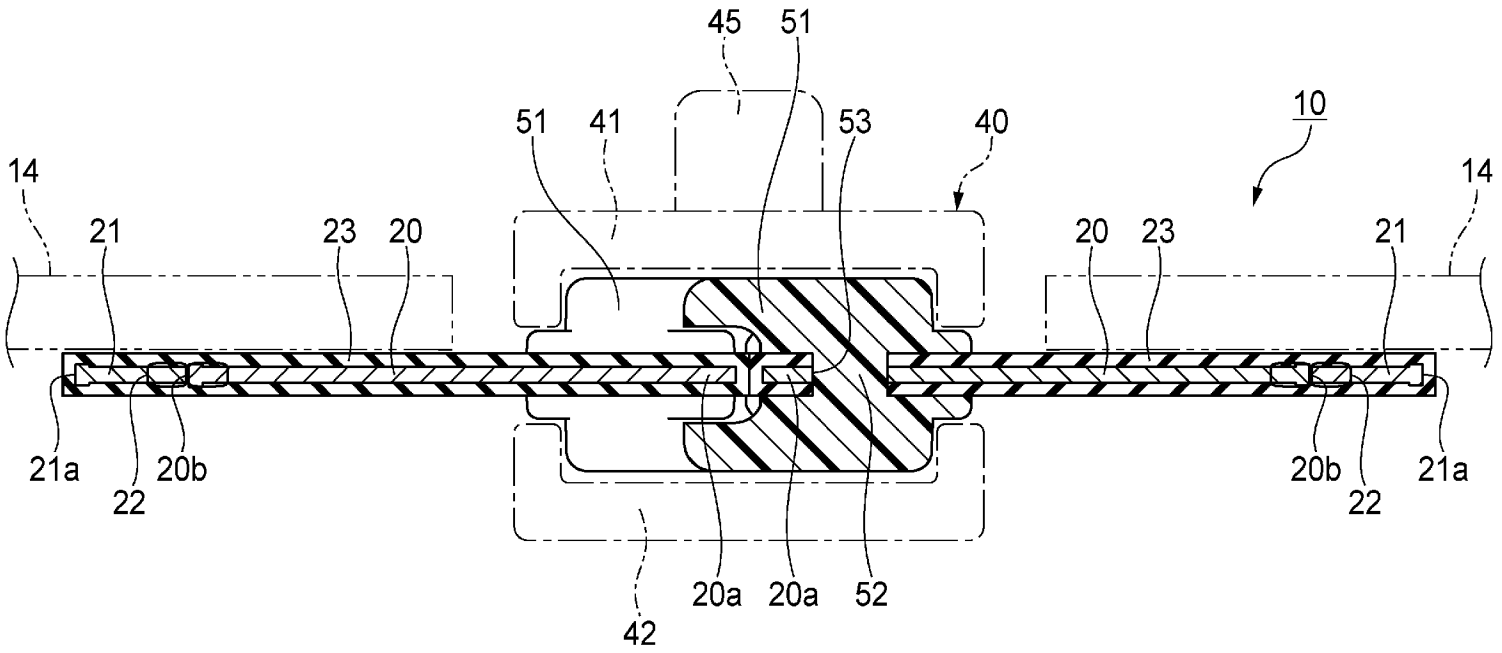
FIG. 12 is a cross-sectional view of the slide fastener shown in FIG. 11.
Figure 13:
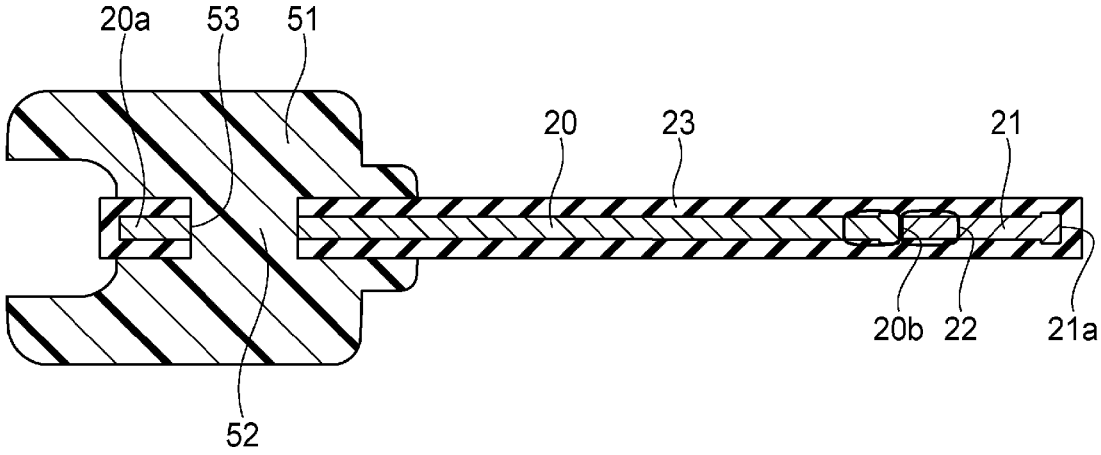
FIG. 13 is an enlarged cross-sectional view of the right fastener tape shown in FIG. 12.

Furthermore, according to a second modified embodiment of this embodiment, as shown in FIG. 11 to FIG. 13, the waterproof layer 23 is formed on both of the front and back surfaces of the fastener tapes 20 and the tape members 21, the side surfaces of the one side edge portions 20*a* of the fastener tapes 20, and the side surfaces of the outer edge portions 21*a* of the tape members 21. In addition, fastener element rows 50 each having a plurality of fastener elements 51 may be injection molded on the one side edge portions 20*a* of the fastener tapes 20 with using synthetic resin. In FIG. 13, reference numeral 52 indicates a connector which connects the fastener elements 51 in the front and back direction of the fastener tape 20, and reference numeral 53 indicates a through-hole which is formed in the one side edge portion 20*a* of each fastener tape 20 in order to form the connector 52.

Figure 14:
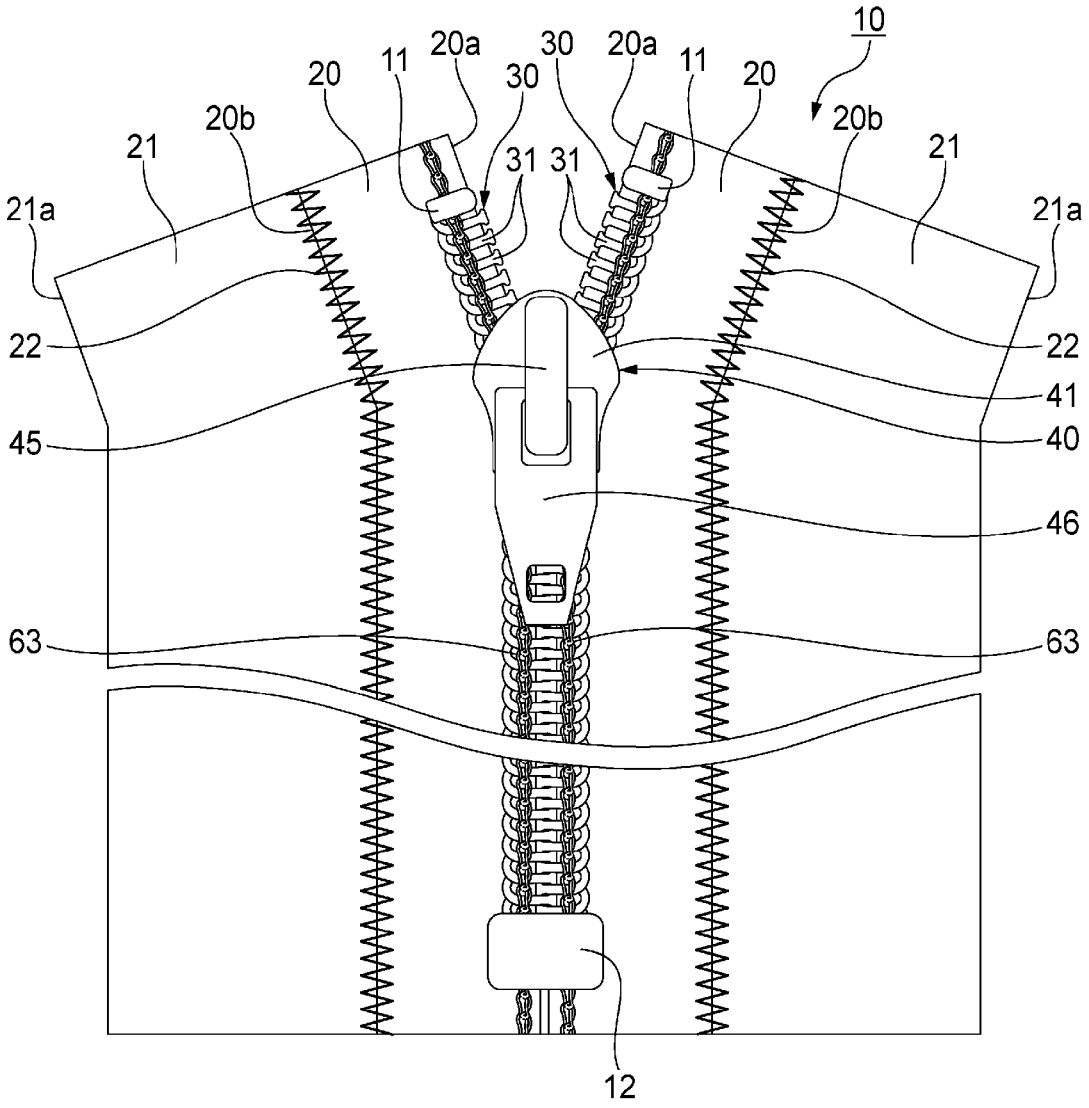
FIG. 14 is a front view illustrating a third modified embodiment of the slide fastener according to the invention.
Figure 15:
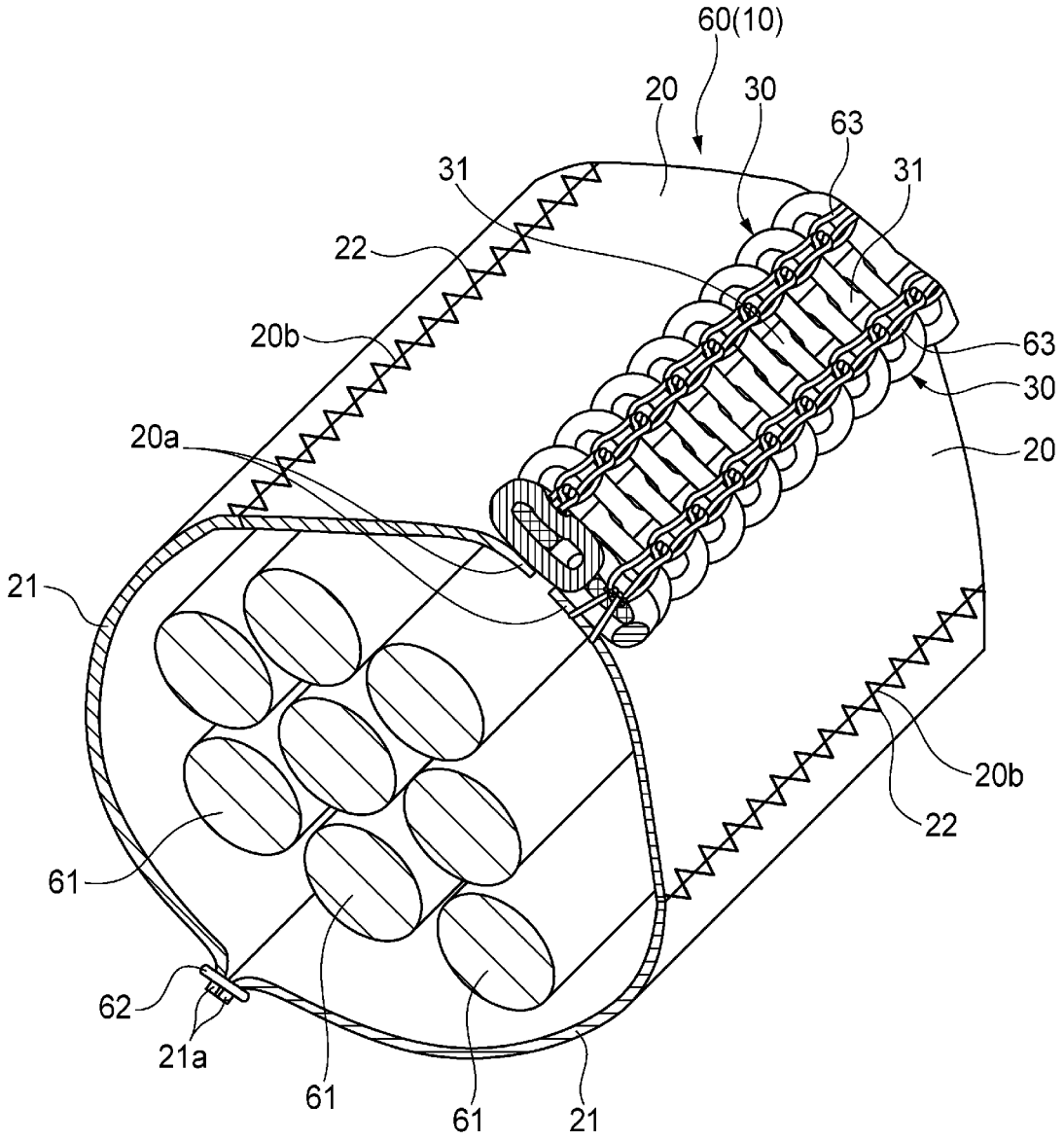
FIG. 15 is a perspective view illustrating an usage example of the slide fastener shown in FIG. 14.

In addition, according to a third modified embodiment of this embodiment, as shown in FIG. 14, the waterproof layer 23 may not be formed. As shown in FIG. 15, this modified embodiment is used for a cover 60 which covers a plurality of electric cords 61 (8 electric cords in this modified embodiment), and the widths of the tape members 21 are set according to the width required for covering the 8 electric cords 61. Furthermore, according to this modified embodiment, the outer edge portions 21*a* of the pair of right and left tape members 21 are sewn to each other with sewing thread 62. In addition, according to this modified embodiment, the fastener element rows 30 are sewn to the one side edge portions 20*a* of the fastener tapes 20 with sewing threads 63 in accordance with double chain sewing.

Figure 16:
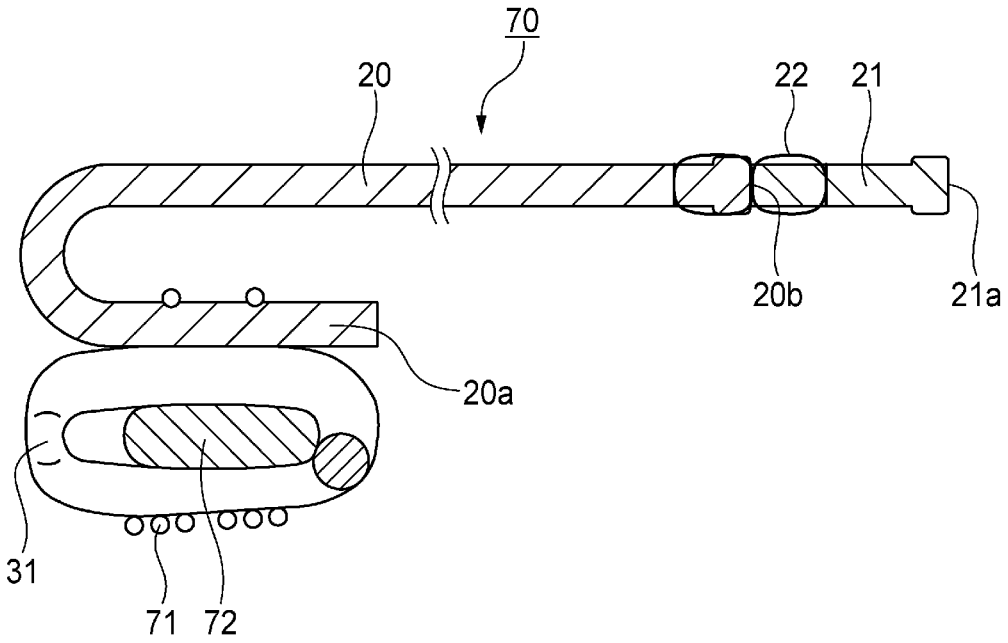
FIG. 16 is a cross-sectional view illustrating a fourth modified embodiment of the slide fastener according to the invention.

According to a fourth modified embodiment of this embodiment, as shown in FIG. 16, the tape members 21 may be sewn to the another side edge portions 20*b* of the fastener tapes 20 of a concealed slide fastener 70. According to this modified embodiment, the one side edge portion 20*a* of each fastener tape 20 is bent substantially into the substantially U-shape and the coil-shaped fastener element row 30 is sewn to the bent portion with sewing thread 71 in accordance with double chain sewing. In FIG. 16, reference numeral 72 indicates a core string which is inserted into and extends through the fastener element row 30 and is sewn together with the fastener element row 30.

The present invention is not limited to the above-illustrated embodiments, but may be properly changed without departing from the concept of the present invention.

For example, when the waterproof layer is formed, the engagement state is not limited to the case in which the right and left waterproof layers abut to each other, but the waterproof layers may not abut to each other. This is because the waterproof layers are used for a decorative purpose in some cases.

The widths of the right and left tape members 21 may not be the same. For example, the width of one side may be greater than the width of the other side.

Furthermore, since the welding margin or bonding margin may be limited according to the attached object that is to be welded or bonded, for example, only one side may have a large width by sewing the tape member thereto, and the other side may be maintained as a typical fastener tape to which the tape member is not sewn.

DESCRIPTION OF REFERENCE NUMERALS

10 Slide Fastener
20 Fastener Tape
20*a* One Side Edge Portion
20*b* The Another Side Edge Portion
20*c* Tape Main Body Portion
21 Tape Member
22 Sewing Thread
23 Waterproof Layer
30 Fastener Element Row
31 Fastener Element
40 Slider

The invention claimed is:

1. A slide fastener comprising:

a pair of fastener tapes;

a pair of fastener element rows respectively provided along opposing one side edge portions of the pair of fastener tapes;

a slider configured to engage and disengage the pair of fastener element rows; and tape members respectively provided in parallel along another side edge portions of the pair of fastener tapes, that are opposite to the one side edge portions, wherein the tape members are respectively sewn to the another side edge portions of the fastener tapes with sewing threads which bridge over the fastener tapes and the tape members, and wherein the respective fastener tapes and the tape members are disposed coplanar in a side-by-side arrangement, and the sewing threads extend laterally in a width direction to bridge the respective fastener tapes and the tape members.

2. The slide fastener according to claim 1, wherein a waterproof layer is formed on at least one side of the fastener tapes and the tape members.

3. The slide fastener according to claim 1, wherein a thickness of the another side edge portions of the fastener tapes is greater than a thickness of tape main body portions.

4. The slide fastener according to claim 1, wherein the sewing threads are thicker than weft of the fastener tapes and the tape members if the fastener tapes and the tape members are made by weaving, and are thicker than insertion weft of the fastener tapes and the tape members if the fastener tapes and the tape members are made by knitting.

5. The slide fastener according to claim 1, wherein the fastener element rows are woven into the fastener tapes at the time of weaving the fastener tapes.

6. A method for manufacturing a slide fastener, wherein the slide fastener comprises:

a pair of fastener tapes;

a pair of fastener element rows respectively provided along opposing one side edge portions of the pair of fastener tapes;

a slider configured to engage and disengage the pair of fastener element rows; and tape members respectively provided in parallel along another side edge portions of the pair of fastener tapes, that are opposite to the one side edge portions, wherein the tape members are respectively sewn to the another side edge portions of the fastener tapes with sewing threads which bridge over the fastener tapes and the tape members, the method comprising:

attaching the fastener element rows to the one side edge portions of the pair of fastener tapes;

disposing the tape members in parallel along the one side edge portions of the fastener tapes; and sewing the tape members to the another side edge portions of the fastener tapes with the sewing threads so the fastener tapes and the tape members are disposed coplanar in a side-by-side arrangement, and the sewing threads extend laterally in a width direction to bridge the fastener tapes and the tape members.

7. The method according to claim 6, further comprising forming a waterproof layer on at least one side of the fastener tapes and the tape members.

* * * * *

UNITED STATES PATENT AND TRADEMARK OFFICE

CERTIFICATE OF CORRECTION

PATENT NO. : 9,237,781 B2
APPLICATION NO. : 14/002753
DATED : January 19, 2016
INVENTOR(S) : Muchiji Shimono It is certified that error appears in the above-identified patent and that said Letters Patent is hereby corrected as shown below:

Specification

In column 7, line 29, delete “bluged” and insert -- bulged --, therefor.

Signed and Sealed this
Twenty-sixth Day of April, 2016

Michelle K. Lee

Michelle K. Lee
*Director of the United States Patent and Trademark Office*